US005244317A

United States Patent [19]

Kuboyama et al.

[11] Patent Number: 5,244,317

[45] Date of Patent: Sep. 14, 1993

[54] SLURRY SUPPLYING DEVICE IN A WET BLASTING SYSTEM

[75] Inventors: Matao Kuboyama; Narihiro Morimoto, both of Shizuoka; Shigeharu Kobayashi, Yokohama, all of Japan

[73] Assignee: Fuji Seiki Machine Works, Ltd., Shizuoka Prefecture, Japan

[21] Appl. No.: 884,064

[22] Filed: May 15, 1992

[30] Foreign Application Priority Data

May 20, 1991 [JP] Japan ..... 3-142655

[51] Int. Cl.[5] ..... B65G 53/16; B65G 53/30; B65G 53/40; B65G 53/36

[52] U.S. Cl. ..... 406/136; 406/146

[58] Field of Search ..... 406/136, 137, 138, 132, 406/146, 197, 122, 47, 48

[56] References Cited

U.S. PATENT DOCUMENTS

| | | | |
|---|---|---|---|
| 417,214 | 12/1889 | Austin | 406/132 X |
| 911,431 | 2/1909 | Nichols | 406/132 X |
| 1,559,666 | 11/1925 | Bernier | 406/146 X |
| 1,933,543 | 11/1933 | Anderson | 406/146 X |
| 2,652,175 | 9/1953 | Davis | 406/132 |
| 2,687,331 | 8/1954 | Seaman | 406/146 |
| 2,688,423 | 9/1954 | Davis | 406/132 |
| 3,053,420 | 9/1962 | de Saint-Martin | 406/132 X |
| 3,231,144 | 1/1966 | Rouanet et al. | 406/137 X |

FOREIGN PATENT DOCUMENTS

| | | | |
|---|---|---|---|
| 1262900 | 3/1968 | Fed. Rep. of Germany | 406/138 |
| 436237 | 10/1974 | U.S.S.R. | 406/137 |
| 143401 | 5/1920 | United Kingdom | 406/136 |
| 1025308 | 4/1966 | United Kingdom | 406/138 |

*Primary Examiner*—David M. Mitchell
*Assistant Examiner*—James M. Kannofsky
*Attorney, Agent, or Firm*—Flynn, Thiel, Boutell & Tanis

[57] ABSTRACT

A slurry supplying device by which a uniformly mixed slurry can be supplied to a blasting gun in a pressure-type wet blasting machine. The slurry supplying device comprises a substantially closed vessel which contains the slurry and has a conical section in at least one part of the vessel. A conical stop valve is freely movable up and down to close the bottom of the slurry settling section by sealingly fitting its conical edge on the conical section of the vessel. An air duct supplies low pressure air for agitating the slurry at a lower part of the closed vessel by raising the stop valve body. An air duct is provided for supplying highly pressurized air into the closed vessel for pressurizing the slurry. A slurry supply pipe is provided for supplying the pressurized slurry to the blasting gun. A pressure relief valve is mounted on the top plate of the vessel for maintaining a maximum air pressure in the upper portion of the vessel.

10 Claims, 3 Drawing Sheets

SLURRY SUPPLYING DEVICE IN A WET BLASTING SYSTEM

FIELD OF THE INVENTION

This invention relates to a slurry supplying device for a wet blasting system.

BACKGROUND OF THE INVENTION

The slurry supplying device in a wet blasting system is used to feed a pressurized slurry (a mixture of solid particles and liquid, mixed in a selected weight ratio) to the blasting gun in said system. For example, referring to attached FIG. 5, Japanese Patent SHO-29 (1954)-3046 discloses a system in which slurry agitation device B is installed at the bottom of a slurry storage tank A. The agitation device B has a shell E of hollow, substantially hemispherical shape, or inverted cup shape, and has a passage D for air flow connected to an air introducing duct C. The agitation device B is submerged in the slurry. A nozzle H, which has air blowing holes G, intersects the air flow tube D and extends at a right angle thereto. Compressed air sent via air introducing duct C is blown out through the air blow holes G and the tube D. The abrasive particles and liquid are agitated and well mixed by the air that is blown from the nozzle H into the slurry. The well-mixed slurry is sent to the blasting gun (not shown) through a slurry supply pipe I.

In the prior art device mentioned in the preceding paragraph, the abrasive particles settle on the bottom of the slurry reservoir and in the slurry circuit when operation of the apparatus is stopped. This presents a difficult problem, when restarting the apparatus, because it is necessary to re-suspend, in the liquid, the solid abrasive particles which may be cohered to each other, for example, when said abrasive particles have a high density or exhibit a cohesive nature. When abrasive particles having a relatively low density (for instance, a specific gravity of 1.0–2.0) or a small particle size (for instance, a mean particle diameter of 50–0.5 $\mu$m) are blasted by a wet blasting machine of the pressure vessel type, the slurry blasted from the blasting gun should be in a well mixed state. This condition is necessary if the object to be blasted has a low hardness or the object must be finished with a uniform surface roughness. Examples of industries in which such a uniformly finished surface is desired are the electronic industry, the finishing or cleaning of dirt from lead frames, the surface preparation of surfaces before P.V.D. or C.V.D., etc.

Adjustment of the operational conditions to meet the requirements of the industries mentioned above is difficult in conventional wet blasting apparatuses because conventional apparatuses are not designed or manufactured to provide the operational conditions necessary to finish the objects to be blasted, using low density particles or particles of very small mean diameter, and using a low blasting pressure.

It is an object of this invention to provide a slurry supplying device in a wet blasting system, in which a uniformly mixed slurry can be obtained easily and no danger exists that the particles will settle on the bottom of the slurry reservoir and in the piping system after the blasting operation has ended.

SUMMARY OF THE INVENTION

To solve the problems mentioned above, according to the invention, there is provided an improved slurry supplying device in a wet blasting system. The slurry supplying device comprises a closed pressure vessel which contains the slurry in a substantially completely closed state, isolated from the ambient atmosphere. The vessel has a frusto-conical, slurry settling section in at least one part of said vessel. A conical or frusto-conical stop valve is movable up and down vertically in the slurry settling section and is adapted to close the lower end of the frusto-conical slurry settling section by sealingly engaging the surface of the frusto-conical slurry settling section of the vessel. A first air pipe for introducing air for agitating the slurry is provided at the lower part of the closed pressure vessel and such air can be introduced into the vessel by raising the stop valve body. In addition, a second air pipe is provided for introducing high pressure air into the upper end of the closed vessel and thereby pressurizing the slurry when it is to be fed to the blasting gun. A slurry supplying pipe is provided to supply pressurized slurry from the closed vessel to the blasting gun.

The slurry supplying device of the wet blasting system is provided with a pressure relief valve in order to keep the air pressure in the closed vessel from exceeding a selected maximum value by discharging excessively pressurized air from the vessel. The pressure relief valve is installed on the cover plate of the closed pressure vessel. When the pressure relief valve is open, excessively pressurized air is continuously discharged from the vessel at a slow rate.

As indicated above, the slurry supplying device of the wet blasting system is provided with a second air introducing pipe for pressurizing the slurry in the closed vessel. In certain embodiments of the invention, the second air introducing pipe can be mounted on the cover plate of the pressure vessel. In other embodiments of the invention, the second air introducing pipe can be mounted below the stop valve.

The slurry supplying device of the wet blasting system can be provided with a slurry supplying pipe for supplying the pressurized slurry to the blasting gun. In some embodiments of the invention, the slurry supplying pipe can be mounted above the stop valve of the pressure vessel. In other embodiments of the invention, the stop valve of the slurry supplying device of the wet blasting system can have a hollow internal cross-section and the hollow interior of the stop valve can communicate with the slurry supplying pipe.

In operation, abrasive particles and liquid are held inside of the closed pressure vessel and above the stop valve, which valve closes the lower end of the pressure vessel. The stop valve is pushed upwardly by the pressure of air that is delivered from the first pipe for supplying agitating air into the slurry. A small gap is thereby created between the stop valve and the conical surface at the lower end of the vessel, the air for agitating and mixing the slurry passes through said gap, passes upwardly through and thereby mixes the abrasive particles and liquid, and thereby forms a uniform slurry in the vessel.

After that, for pressurizing the slurry in the vessel, compressed air is supplied into the pressure vessel through the second pressurizing air pipe. The pressurizing air is effective to discharge the slurry to the blasting gun through the slurry supplying pipe.

When the second air pipe for supplying air for pressurizing the slurry is provided above the stop valve of the pressure vessel, the stop valve is moved downwardly by gravity, augmented by the force of the pressurizing air. The pressurized slurry is thereby supplied into the slurry supply pipe. When the second air pipe for supplying air for pressurizing the slurry is provided beneath the stop valve, the slurry is supplied to the slurry supply pipe while the stop valve remains in a raised (open) position.

The pressure relief valve mounted on the cover plate of the pressure vessel discharges pressurized air from the vessel in a small limited amount and thereby tends to maintain the pressure in the vessel not higher than a selected maximum pressure.

DETAILED DESCRIPTION

Figure 1:
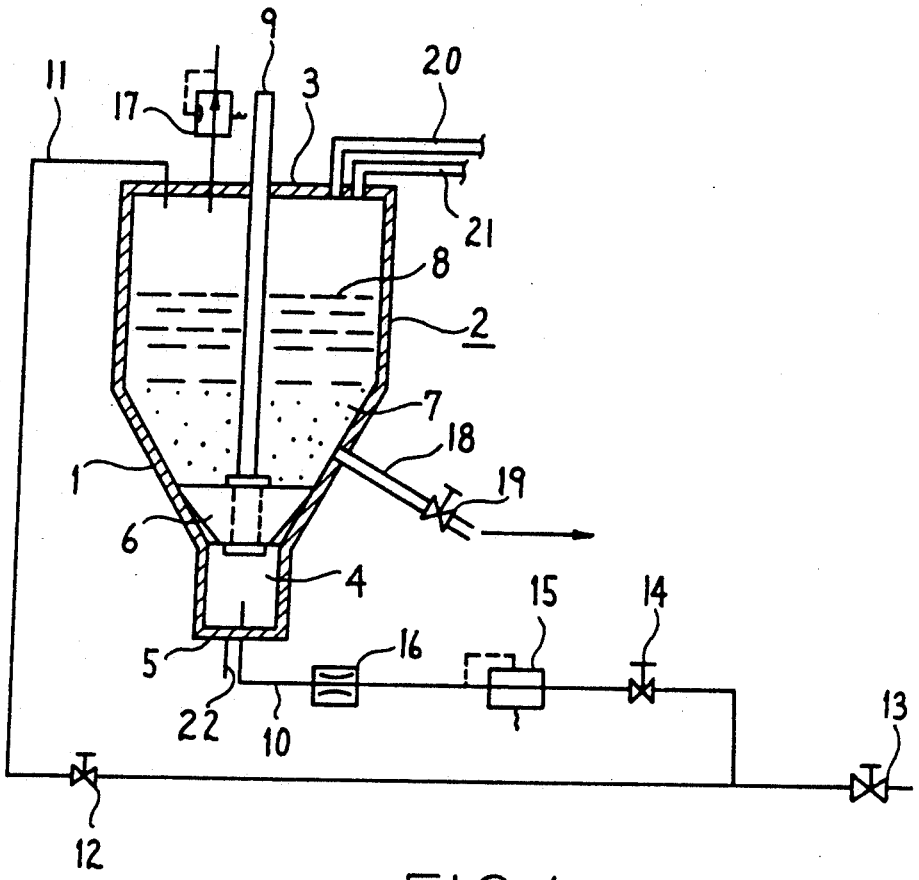
FIG. 1 is a schematic sectional view of the slurry supplying device of the wet blasting machine according to a first embodiment of the invention.

Referring to FIG. 1, there is shown a closed vessel (pressure vessel) 2 having an inverted frusto-conical section 1 toward its lower end. The closed vessel 2 is tightly closed on its upper end by a cover plate 3. An actuating section 4 in the shape of a cylinder is provided directly below the lower end of the section 1. The cylinder 4 is tightly closed by a bottom plate 5. A vertically movable stop valve 6 is disposed inside the section 1. The body of the stop valve 6 has the shape of an inverted, truncated cone, and it is adapted to sealingly seat on the conical inner surface of the section 1 of the vessel 2, in order to tightly close the bottom of the portion of the pressure vessel 2 located thereabove. A carrier liquid 8 and abrasive particles 7, effective for forming an abrasive slurry, are contained in the pressure vessel 2 above the stop valve 6.

The stop valve 6 can be raised or lowered smoothly by a valve rod 9 which extends through the cover plate 3.

A first air introducing pipe 10 is provided for mixing pressurized air with the slurry in order to agitate the slurry. The pipe 10 extends upwardly through the bottom plate 5 of the actuating section 4 of the pressure vessel. A second pipe 11 for introducing pressurized air for pressurizing the slurry and feeding the pressurized slurry to the blasting gun extends through the cover plate 3. An air shut-off valve 12 is provided in the pipe 11 and said pipe 11 is connected to a main air supply valve 13. The air introducing pipe 10 for supplying air for mixing the slurry is separate from the pressurized air pipe line 11. The air introducing pipe 10 has a shut-off valve 14, a pressure relief valve 15 and a flow regulating valve 16 connected in series therein.

A pressure relief valve 17 is provided on the cover plate 3. This valve 17 discharges excessively pressurized air from the pressure vessel 2 at a slow rate and is effective to reduce the air pressure in the upper end of the vessel to a selected maximum value which is sufficient to supply the slurry to the blasting gun at the desired blasting pressure. Reference numeral 18 identifies a supply pipe for supplying pressurized slurry to the blasting gun at the blasting pressure. Reference 19 identifies a valve for stopping the flow of pressurized slurry to the blasting gun, 20 identifies an abrasive particle supply pipe mounted on the cover plate 3, 21 identifies a liquid supply pipe, and 22 identifies a drain pipe.

The operation of the first embodiment of the present invention is as follows. At first, the shut-off valve 12 is closed and the valve 14 for supplying agitating air is open. The main air supply valve 13 is open. By these operations, high pressure compressed air (2–5 kgf/cm.cm.) is sent through the pipe 10 into the section 4, raises the stop valve 6 and thereby supplies mixing (agitating) air into the lower end of the vessel 2. The pressure relief valve 17 is set to open at a pressure which is 5–10% lower than the pressure of the air supplied into the actuating section 4 by the line 10. Thus, air having a higher pressure than the pressure at which pressure relief valve 17 opens is sent to the actuating section 4 of the pressure vessel 2 via the flow regulating valve 16 and the pressure relief valve 15.

Air delivered from the air introducing pipe 10 raises the stop valve 6 because the air pressure in section 4 is higher than the air pressure in the upper section of vessel 2 above the slurry. A small gap is established between the valve 6 and the inner, inverted, frusto-conical surface of the section 1 of the pressure vessel 2. Agitating air passes through this gap and flows through and thoroughly mixes the solid particles and carrier liquid in the vessel 2 above the valve 6 to make a uniformly mixed slurry. The air for mixing the slurry escapes into the upper section of the vessel 2 above the slurry. When the air pressure builds up to a selected value in the upper section of the vessel 2, the pressure relief valve 17 opens. Since valve 17 is set to open at a somewhat lower pressure than the pressure of the air supplied through pipe 10, there is a continuous bleeding of excess air pressure and a continuous flow of air through the slurry to agitate same continuously.

After the uniformly mixed slurry is formed and it is desired to feed the slurry to the blasting gun, the shut-off valve 14 is closed and the shut-off valve 12 is opened. High pressure air is introduced into the upper end of the pressure vessel 2 through the second pipe 11. There being no pressurized air supplied to section 4 at this time, the stop valve 6 descends in response to the pressure of the air introduced into the upper end of the vessel 2 and applied against the upper surface of the slurry. The stop valve 6 seals against the conical surface 1 and closes the gap. The slurry can be fed to the blasting gun through the slurry supply line 18 in response to the high pressure air introduced into the upper end of the vessel 2.

The pressure of the air supplied through line 11 is higher than the pressure of the air supplied through the line 10.

If the air pressure in the pressure vessel 2 becomes too high during the slurry agitating step and agitation (mixing) of the slurry becomes too vigorous, the supply of slurry to the blasting gun will become difficult. In such a case, the pressure relief valve 17 opens to reduce the pressure in the vessel 2 above the slurry. The valve 17 discharges excess air pressure in the vessel 2 at a slow controllable rate to make the air pressure in the vessel not exceed a predetermined pressure and so that air will flow through the slurry and into the upper end of the vessel 2 at a substantially constant rate and the excess air will continuously leak out through the valve 17.

MODIFICATIONS

The second embodiment of the present invention will be explained by reference to FIG. 2. In this example, the first pipe 10 for introducing air for agitating the slurry and the second pipe 11 for introducing air for pressurizing the slurry extend through the side wall of the actuating section 4 at the lower end of the pressure vessel 2.

Figure 2:
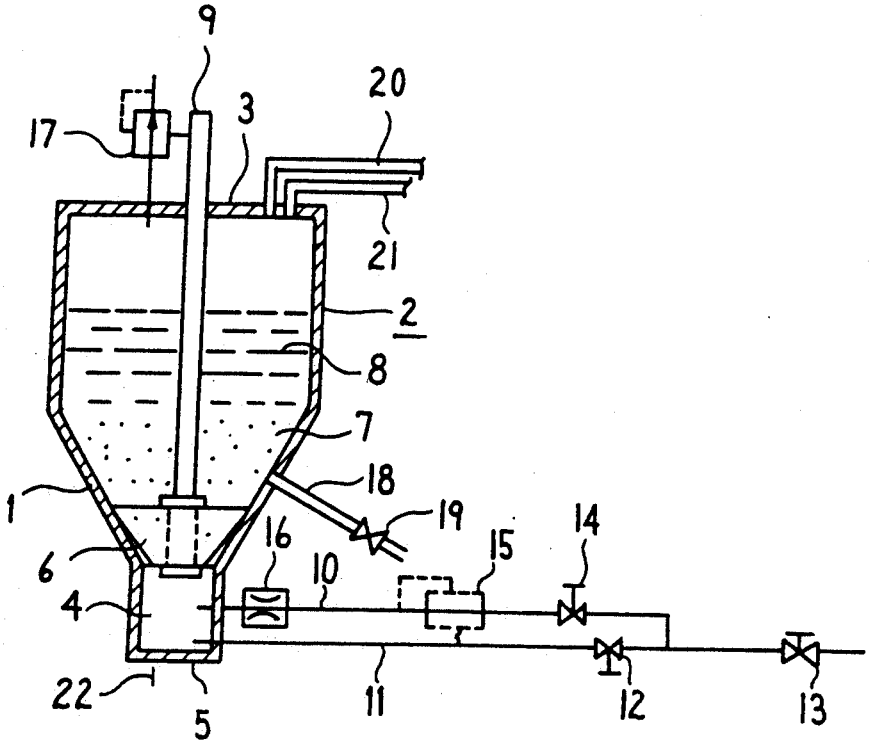
FIG. 2 is a view like FIG. 1, and showing a second embodiment of the invention.

The other parts of the apparatus of FIG. 2 are the same as those in FIG. 1 and further description will be omitted.

In the second embodiment of this invention, at first, the stop valve 6 is raised by the relatively lower pressure air fed into section 4 from the first air introducing pipe 10, and then the abrasive particles and liquid are agitated by the air that passes through the gap so that a uniform slurry is formed. Then, more highly pressurized air is introduced through the pipe 11 and passes through the gap between the valve body of the stop valve 6 and the conical surface of the vessel section 1. The air flows upwardly through the slurry and pressurizes the upper portion of the vessel above the upper surface of the slurry. The contents of the pressure vessel are thereby pressurized and the slurry in the vessel can be supplied to the blasting gun via the slurry supply pipe 18.

Figure 3:
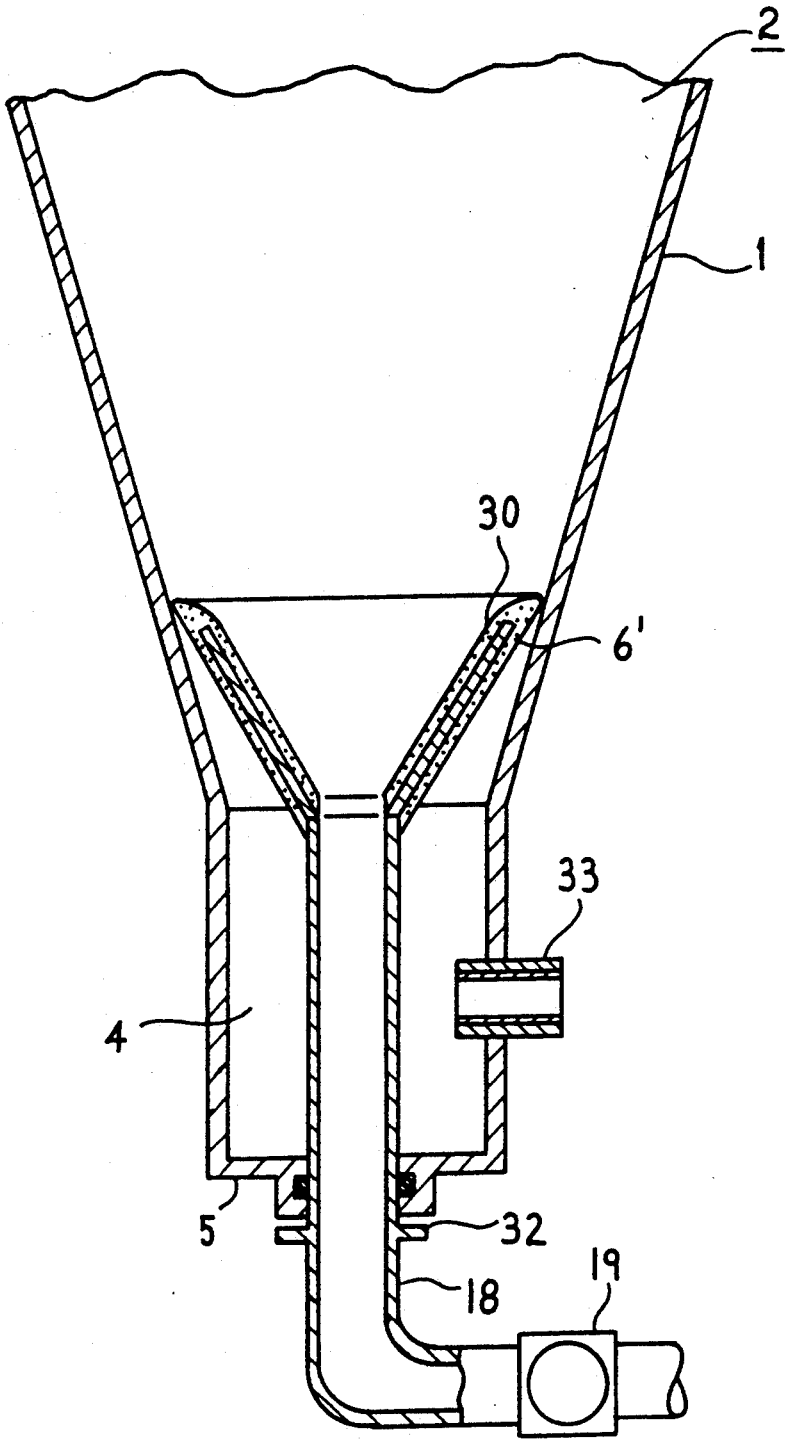
FIG. 3 is a view like FIG. 1, and showing a third embodiment of the invention.

The third embodiment of the present invention is explained by reference to FIG. 3. The pressure vessel 2 is the same as that in the first embodiment. The stop valve 6' has the shape of a truncated, inverted, hollow cone. The body of this stop valve 6' is made of natural rubber of a hardness of about 50 durometer or a like elastomer having substantially the same physical nature. The stop valve body is reinforced by an internal steel core 30. The bottom end of the hollow interior of the stop valve 6' is connected to the upper end of the slurry supply pipe 18. A ring 32 is provided on the slurry supply pipe 18 and serves as a stopper for preventing the stop valve 6' from being raised too high. An air inlet 33 opens through a side wall of the actuating section. The air for agitating the slurry and the air for pressurizing the slurry to feed it to the blasting gun can be alternately supplied through air inlet 33 by changing the route of air supply.

In the operation of the third embodiment, air for agitating the slurry is introduced from the air introduction pipe 33 and pushes up the stop valve 6' together with the slurry supply pipe 18. A gap is formed between the conical surface of the vessel 2 and the stop valve 6'. The slurry mixing air rises through the gap and flows toward the upper portion of the vessel 2. Abrasive particles and carrier liquid in the zone above the stop valve 6' are mixed and made into a slurry. Then the air flow to the pipe 33 is changed from the lower pressure, slurry mixing, air route to the higher pressure, slurry discharging, air route. The pressure inside the upper end of the pressure vessel 2 rises. Then the pressurized slurry in the vessel is sent to the blasting gun (not shown in the drawing) through the hollow interior of the stop valve 6 and the slurry supply pipe 18

In this example, the high pressure, pressurizing air for discharging the slurry can be introduced from the inlet pipe 11 on the cover plate 3 as shown in the first embodiment, instead of being flowed through the pipe 33.

The pressure of the agitating air and of the pressurizing air may be equal. In such a case, the pressure relief valve 17 on the cover plate works and air leaks from the pressure relief valve and serves to make air flow from the bottom of the vessel to the top.

When the high pressure, slurry pressurizing air is being supplied fully, the stop valve 6' descends by gravity and by the weight of the slurry, and closes the gap between the edge of the valve and the conical surface of the vessel.

The slurry stop valve 19 will be closed at the end of the blasting operation.

Figure 4:
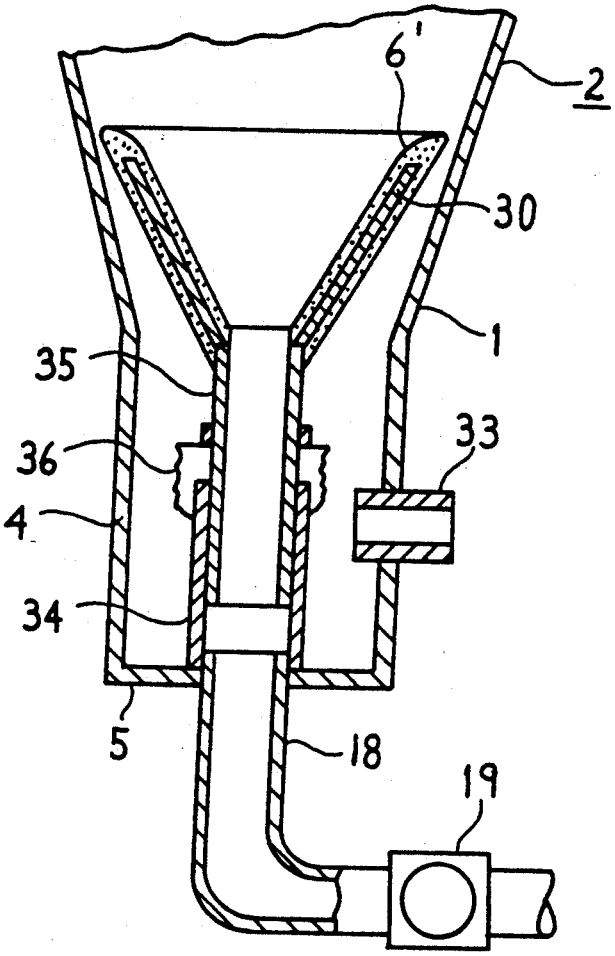
FIG. 4 is a view like FIG. 1, and showing a fourth embodiment of the invention.
Figure 5:
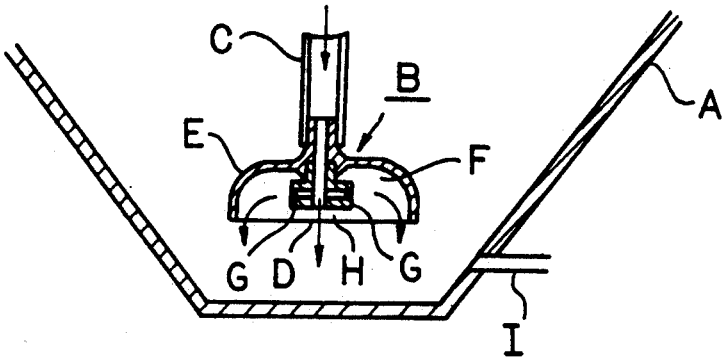
FIG. 5 PRIOR ART
FIG. 5 is a schematic sectional view of a prior art slurry supplying device.

Next, the fourth embodiment of the invention is described with reference to FIG. 4. The upper end of the slurry supply pipe 18 is fixed inside a guide tube 34 which extends upwardly inside the actuating section 4. A tube 35 is mounted on the lower end of the stop valve 6'. The tube 35 vertically slidably fits inside the guide tube 34 so as to be freely vertically movable therein. A bellows 36 extends between the upper side of the guide tube 34 and the middle of the duct tube 35, thus covering the periphery of the guide tube 34 and the tube 35. The bellows 36 keeps out any outside air which may otherwise tend to infiltrate into the interior of tubes 18, 34 and 35

In this fourth embodiment, and different from the third embodiment, vertical movement of the stop valve 6' is independent of other parts of the apparatus and the slurry supply pipe 18 remains fixed. The bellows 36 keeps the two parts free of outside air.

In the invention, the abrasive particles and liquid are held in the upper section of the vessel 2 above the stop valve 6'. Hence, the abrasive particles do not cohere to each other when they settle toward the bottom of the vessel 2. They can more easily form a uniform slurry of abrasive particles and liquid in a short time by introducing air from the actuating section 4 and by mixing them.

By forming the stop valve 6 in a hollow shape and thus offering passage of the slurry directly from the bottom of the vessel to the slurry supply pipe 18, starting and stopping of the flow of slurry can be effected without trouble. The slurry is supplied in a simple way.

The pressure relief valve 17 serves for maintaining the pressure in the vessel 2 more constant, and the slurry is supplied to the blasting gun smoothly.

The embodiments of the invention in which an exclusive property or privilege is claimed are defined as follows:

1. In a wet abrasive blasting apparatus using a slurry comprised of abrasive particles and a liquid carrier therefor, a slurry supplying device comprising: a closed pressure vessel for containing the slurry, said pressure vessel having a frusto-conical section; a vertically movable stop valve of frusto-conical shape disposed in said section of said vessel and adapted to be moved between a closed position in which it sealingly engages a wall of said section and an open position in which it is vertically spaced from the wall of said section; and conduit means connected to said vessel for supplying a first stream of air for moving said valve from its closed position to its open position and to agitate the slurry and for supplying a second stream of air for pressurizing the slurry in said vessel and supplying the pressurized slurry to a blasting gun.

2. A wet abrasive blasting apparatus as claimed in claim 1 in which said conduit means comprises a first conduit connected to said vessel below said stop valve for supplying said first stream of air and a second conduit connected to the upper end of said vessel above said stop valve for supplying said second stream of air.

3. A wet abrasive blasting apparatus as claimed in claim 1 including a slurry supplying conduit for supplying slurry to a blasting gun, said slurry supplying conduit being connected to said vessel above said stop valve.

4. A wet abrasive blasting apparatus as claimed in claim 1 in which said stop valve has a hollow interior which is open on its upper side and including a slurry supplying pipe for supplying slurry to a blasting gun, said slurry supplying pipe being connected to the hollow interior of said stop valve.

5. A wet abrasive blasting apparatus as claimed in claim 1 in which said conduit means is connected to said vessel below said stop value.

6. A wet abrasive blasting apparatus as claimed in claim 5 in which said conduit means comprises a first conduit connected to said vessel below said stop valve for supplying said first stream of air and a second conduit connected to said vessel below said stop valve for supplying said second stream of air.

7. A wet abrasive blasting apparatus as claimed in claim 1, further including a pressure relief valve on the upper end of said pressure vessel in order to keep the pressure applied on said slurry from exceeding a selected maximum value.

8. A wet abrasive blasting apparatus as claimed in claim 7 in which said conduit means comprises a first conduit connected to said vessel below said stop valve for supplying said first stream of air and a second conduit connected to the upper end of said vessel above said stop valve for supplying said second stream of air.

9. A wet abrasive blasting apparatus as claimed in claim 7 in which said conduit means is connected to said vessel below said stop value.

10. A wet abrasive blasting apparatus as claimed in claim 9 in which said conduit means comprises a first conduit connected to said vessel below said stop valve for supplying said first stream of air and a second conduit connected to said vessel below said stop valve for supplying said second stream of air.

* * * * *

UNITED STATES PATENT AND TRADEMARK OFFICE

CERTIFICATE OF CORRECTION

PATENT NO. : 5 244 317

DATED : September 14, 1993

INVENTOR(S) : Matao KUBOYAMA et al

It is certified that error appears in the above-identified patent and that said Letters Patent is hereby corrected as shown below:

Column 7, line 15; change "value" to ---valve---.

Column 8, line 14; change "value" to ---valve---.

Signed and Sealed this

Nineteenth Day of April, 1994

*Attest:*

*Attesting Officer*

BRUCE LEHMAN

*Commissioner of Patents and Trademarks*